US006666299B2

(12) United States Patent
Cole

(10) Patent No.: US 6,666,299 B2
(45) Date of Patent: Dec. 23, 2003

(54) MOVABLE SCAFFOLD AND METHOD FOR PAINTING CYLINDRICAL TANK

(76) Inventor: Michael J. Cole, 5940 52nd St., Newaygo, MI (US) 49337

( * ) Notice: Subject to any disclaimer, the term of this patent is extended or adjusted under 35 U.S.C. 154(b) by 0 days.

(21) Appl. No.: 10/081,568

(22) Filed: Feb. 22, 2002

(65) Prior Publication Data

US 2003/0159884 A1 Aug. 28, 2003

(51) Int. Cl.[7] ..... E04G 1/18; E04G 3/10

(52) U.S. Cl. ..... 182/145; 182/142; 182/150

(58) Field of Search ..... 182/145, 142, 182/150, 39, 141, 143, 144, 147, 148, 36, 37, 101–103, 112; 248/82

(56) References Cited

U.S. PATENT DOCUMENTS 3,854,550 A * 12/1974 Shingler ..... 182/142 X 4,753,321 A * 6/1988 Winslow ..... 182/145

* cited by examiner

*Primary Examiner*—Hugh B. Thompson
(74) *Attorney, Agent, or Firm*—Waters & Morse, P.C.

(57) ABSTRACT

A movable scaffolding for painting or otherwise servicing the sides of a cylindrical tank or like structure comprises a remote controlled, powered truck that is positioned adjacent a peripheral edge of the tank and directed for circular movement around the tank. A tether connects the truck to the tank and constrains the truck to movement in a circular path around the vertical axis of the tank. A vertically raisable platform is attached to an outer side of the truck for vertical movement along outer sides of the tank. In one aspect of the invention, the truck comprises a radially oriented beam, with at least one and preferably two longitudinally spaced wheels rotatably mounted on radially oriented axles. The tether is operatively connected with an inner end of the beam, while the platform is operatively connected with an outer end of the beam

11 Claims, 4 Drawing Sheets

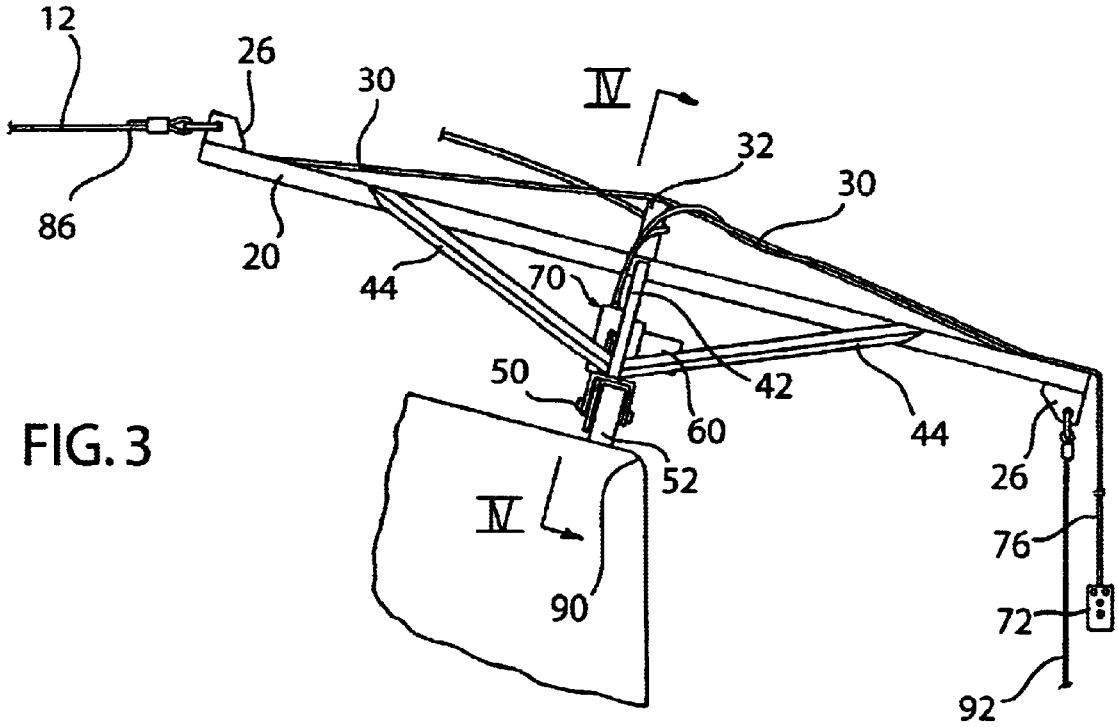
FIG. 3
FIG. 4
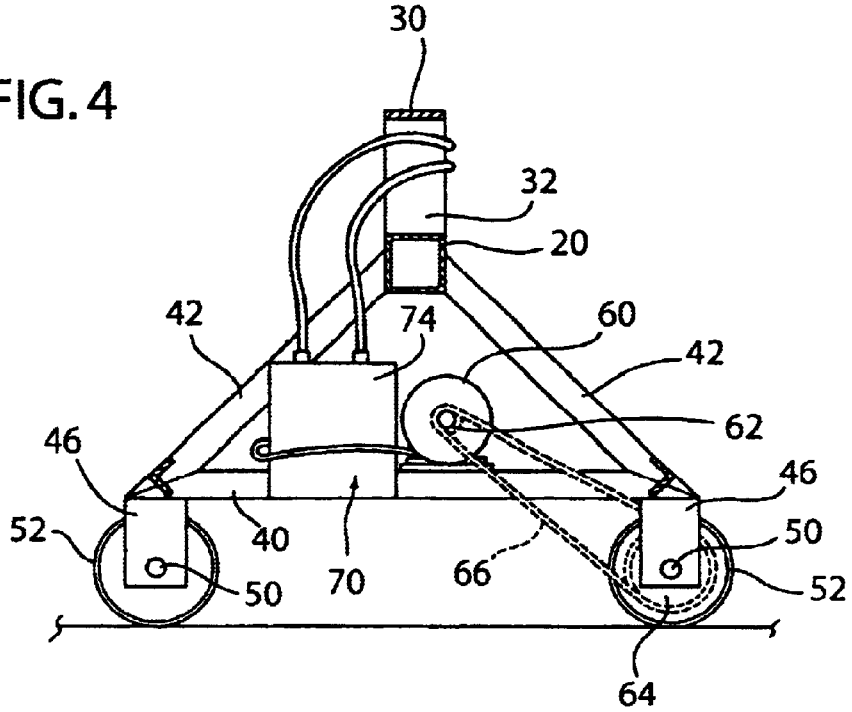

MOVABLE SCAFFOLD AND METHOD FOR PAINTING CYLINDRICAL TANK

BACKGROUND OF THE INVENTION

The invention relates to commercial painting scaffolding for painting or otherwise servicing the elevated sides of a cylindrical tank or like structure. More particularly, the invention relates to scaffolding that is supported on the top of a cylindrical tank and is driven around the tank by a remotely controlled drive mechanism.

BRIEF SUMMARY OF THE INVENTION

In accordance with the present invention, a movable scaffolding for painting or otherwise servicing the sides of a cylindrical tank or like structure comprises a remote controlled, powered, truck that is positioned adjacent a peripheral edge of the tank, a tether that connects the truck to the tank and constrains the truck to movement in a circular path around the vertical axis of the tank, and a vertically raisable platform attached to an outer side of the truck for vertical movement along outer sides of the tank.

In one aspect of the invention, the truck comprises a radially oriented beam, with at least one and preferably two longitudinally spaced wheels rotatably mounted on radially oriented axles. The tether is operatively connected with an inner end of the beam, while the platform is operatively connected with an outer end of the beam These and other features, objects, and benefits of the invention will be recognized by one having ordinary skill in the art and by those who practice the invention, from the specification, the claims, and the drawing figures.

BRIEF DESCRIPTION OF THE SEVERAL VIEWS OF THE DRAWING

FIG. 3 is an enlarged elevational view thereof, taken along line III—III of FIG. 1;

FIG. 4 is a partial cross-sectional view thereof, taken along line IV—IV of FIG. 3.

DETAILED DESCRIPTION OF THE INVENTION

Figure 1:
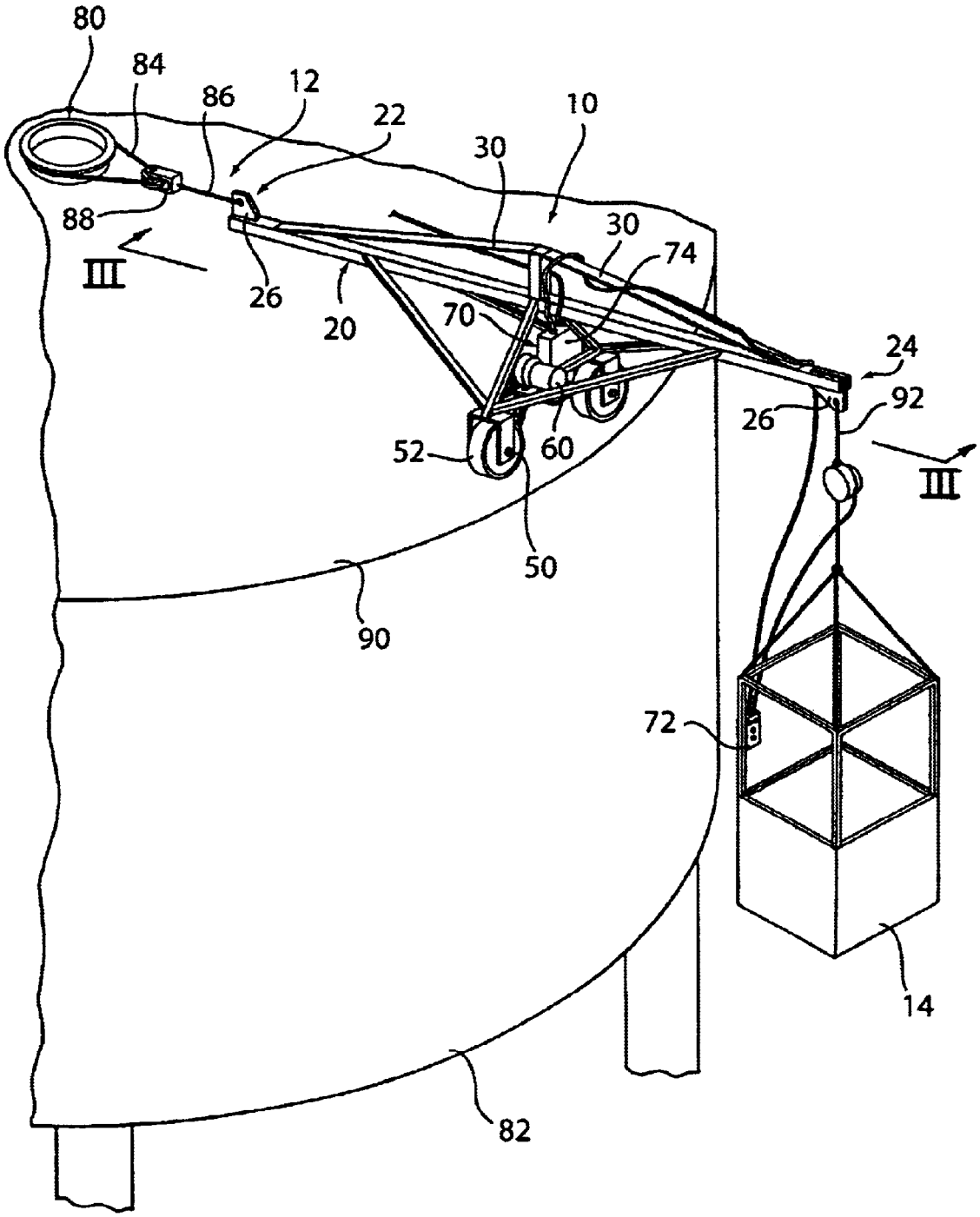
FIG. 1 is a perspective view of a painting scaffold with truck of the invention, shown relative to a tank structure.

A preferred embodiment of a painting scaffold with truck of the invention is generally shown in the drawing figures. The major components of the invention are a powered truck 10, a truck tether 12, and a scaffold platform or basket 14.

Figure 2:
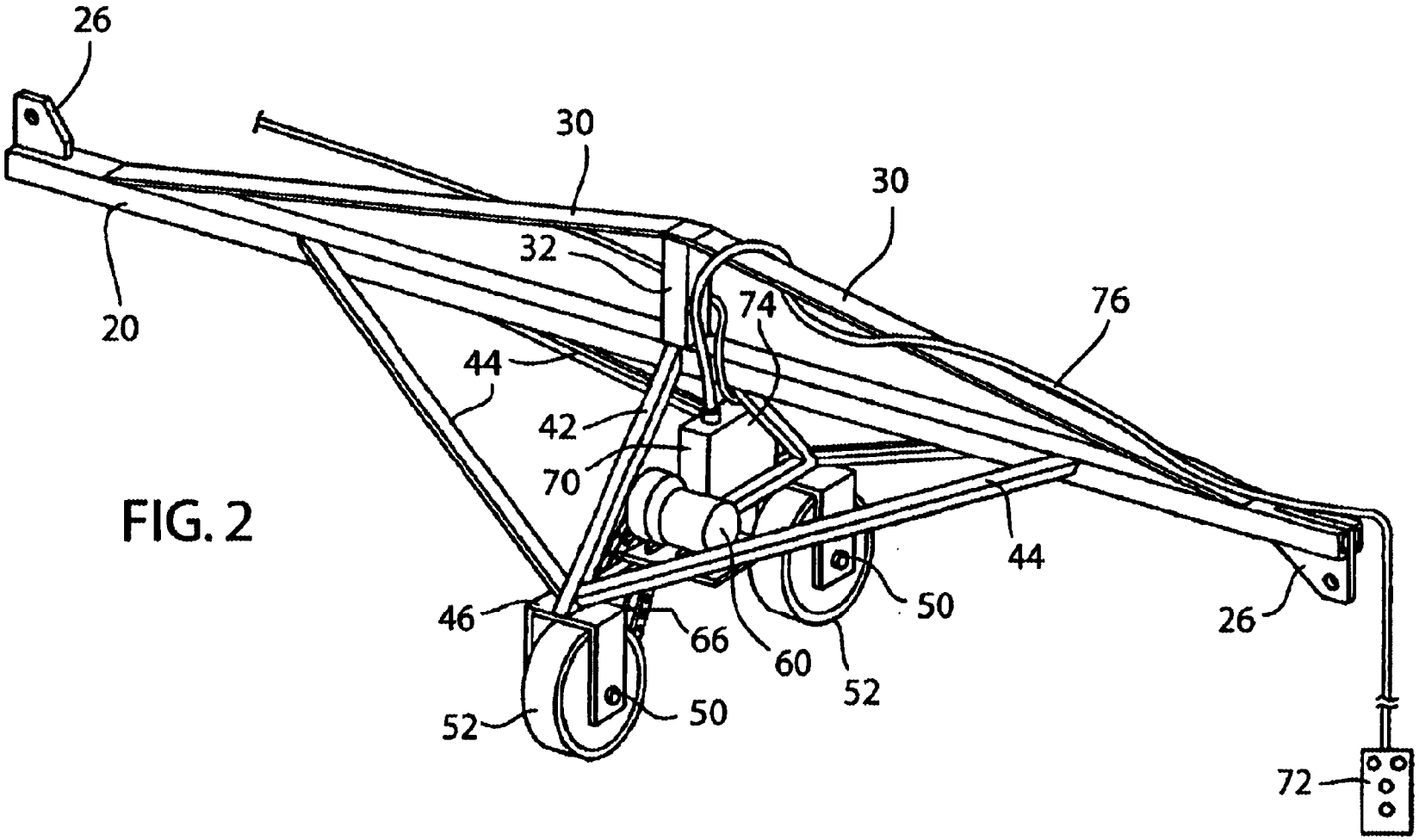
FIG. 2 is an enlarged perspective view of the truck.
Figure 5:
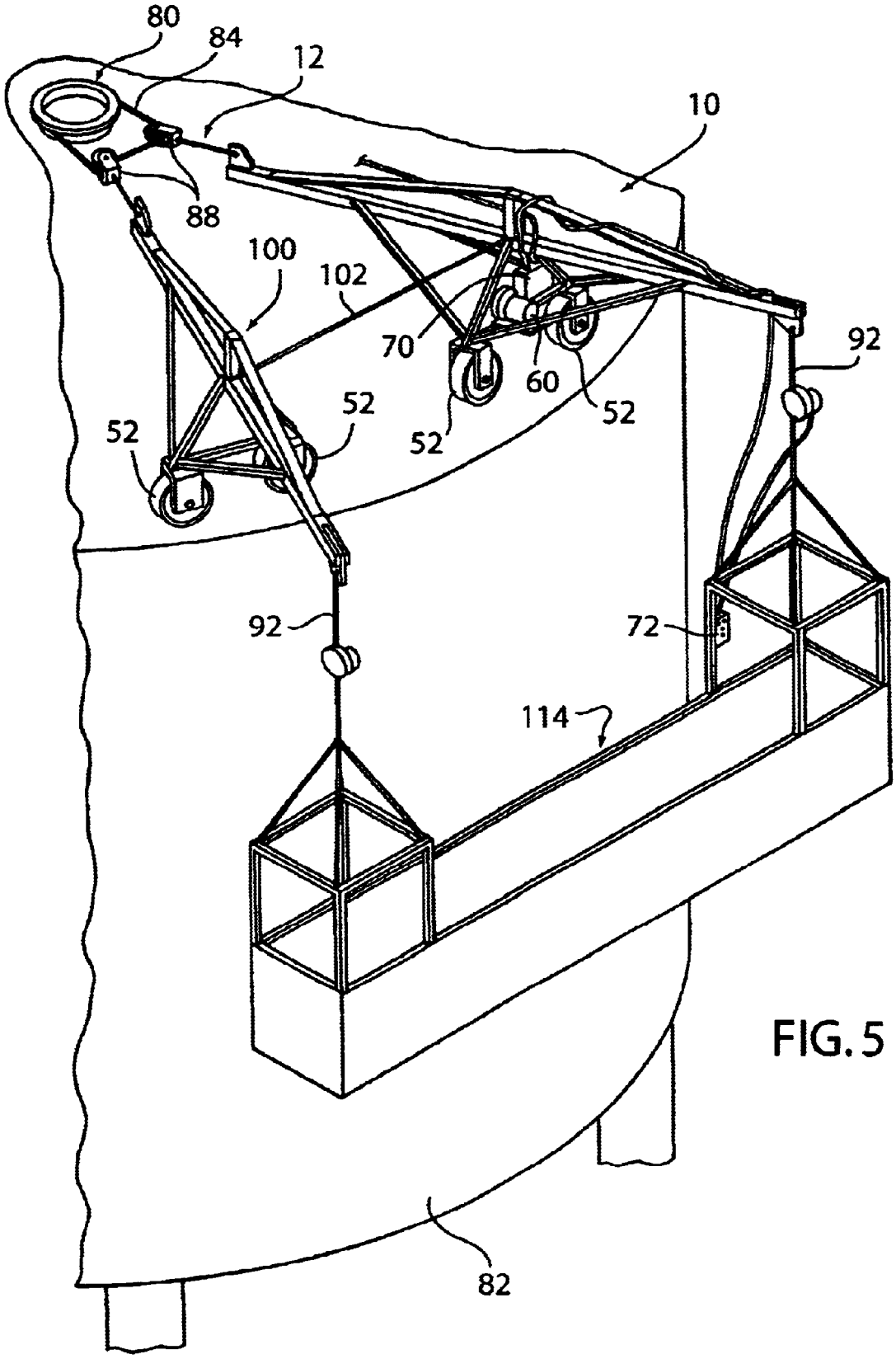
FIG. 5 is the view of FIG. 1, showing a non-driven truck towed by a driven truck with the two trucks suspending a large scaffold platform.

The truck 10 has a beam 20 that extends along a beam axis between a first beam end 22 and an opposing second beam end 24 (FIG. 1). Tie pads 26 are preferably provided at each of the opposing ends 22 and 24, although other fastening devices may be substituted as will be understood by one having ordinary skill in the art (FIGS. 1 and 2). The beam 20 may be constructed of any suitable structural material by any method appropriate to the material selected. Metal, wood, and plastic may be successfully used for the beam 20, for example. An about 108 inch (2743 mm) length of two inch (51 mm) square, standard strength, mild steel tubing has been found to work well for the beam, for example.

The beam 20 may be strengthened from sagging with tension straps 30 (FIG. 2). The straps 30 maybe constructed of lengths of about two inch (51 mm) by about quarter inch (6 mm) mild steel that extend between the opposing ends 22 and 24 of the beam. The straps 30 are spaced about 10 inches (254 mm) above the beam 20 at an about mid-point of the beam by another length 32 of two inch (51 mm) square, standard strength, mild steel tubing. One having ordinary skill in the art will understand that cables or rods may be used instead of the straps 30, for example. Further the beam 20 may be constructed without need of further strengthening, although this would tend to an unduly heavy beam.

A carriage portion is constructed under the beam 20. A main carriage member 40 is connected by an array of secondary stringers 42 and 44 (FIG. 4). The main carriage member 40 is preferably an about thirty inch (762 mm) length of one inch (25 mm) square, standard strength, mild steel tubing. Two secondary stringers 42 may be about twenty-one inch (533 mm) lengths of one inch (25 mm) square, standard strength, mild steel tubing, that extend from opposing ends of the member 40 to meet at opposing sides of the beam 20, at about the mid-point of the beam 20. Four secondary stringers 44 may be lengths of standard strength one inch (25 mm) angle iron. Two of the four secondary stringers 44 extend from the opposing ends of the member 40 toward the first end 22 of the beam 20, and meet at opposing sides of the beam 20 at a point about two thirds of the length of the beam 20 from the stand off 32 to the end 22. The other two of the four secondary stringers 44 extend symmetrically from the opposing ends of the member 40 toward the second end 24 of the beam 20, and meet at opposing sides of the beam 20 at a point about two thirds of the length of the beam 20 from the stand off 32 to the end 24.

Wheels are mounted to the carriage with a pair of generally U-shaped wheel brackets 46, which may be fabricated of quarter inch (6 mm) thick, two inch (51 mm) wide mild steel. The wheel brackets 46 are preferably connected at the opposing ends of the main carriage member 40 and aligned with each other in a downward opening orientation (FIGS. 1–4). The legs of each bracket 46 are drilled to receive a wheel axle 50, which may be provided as a half inch (13 mm) bolt, for example. The axles 50 are preferably parallel with one another. A wheel 52 is provided on each axle 50. Ten inch (254 mm) diameter steel wheels with a molded on two and a half inch (64 mm) polyurethane tread have been found to perform well.

The truck 10 may be propelled with an about half horse power electric motor 60, for example. The motor 60 may be mounted on the main carriage member 40 and a chain drive may interconnect the motor 60 with one of the wheels 52. More particularly, the chain drive may include an eleven tooth drive pinion 62 on the motor shaft, a sixty tooth plate sprocket 64 on the one wheel 52, and a no. 35 chain 66 engaging the pinion 62 and sprocket 64 (FIG. 4). A standard forward and reverse electric circuit 70 may be operatively connected with the motor 60. The circuit 70 may include a control box 74 and a pendant control 72. The control 72 is preferably connected with the control box 74 by a cable 76 that is routed along the beam 20, from the control 70 toward the second end 24 of the beam. The cable 76 preferably has a length that allows the pendent control 72 to hang below the second end 24 a sufficient distance that it is conveniently accessible by a user in the work basket 14 when in the uppermost position. Thus, a user in the work basket 14 may manipulate forward, reverse, and stop modes of the drive 70, and movement of the truck 10, by actuation of the control 72.

Because of a pendulum effect upon the basket 14, the truck is most preferably driven only when the basket 14 is suspended near the beam 20, not away from the beam. If for only this safety issue, the pendant control 72 may hang down from the end 24 of the beam 20, only so far as it is accessible when the basket 14 is suspended in an upper most position under the beam. The control 72 does not need to travel with the basket 14.

The truck 10 is anchored at the first end 22 by the tether 12 to an anchor 80. The anchor 80 will commonly be a man hole access to a tank 82 that is to be painted, or the like. The tether 12 may include a choker cable 84 that loops around the anchor 80; a leash 86 that extends between the truck tie pad 26 at end 22 and the choker 84; and a block 88 that interconnects the leash and choker. Lengths of a common half inch (13 mm) wire rope may be used for the choker 84 and the leash 86, although one having ordinary skill in the art will know that other cable or rope devices may also be used with good effect. At the opposing or second end 24 of the beam 20, the scaffold platform or basket 14 is attached to the tie pad 26 and suspended under the truck 10. The platform 14 may be any of numerous commercially available work baskets or the like. The inventor has used a commonly known Spider™ basket, for example.

In use, the truck 10 and tether 12 may be located on top of a tank 82 or other structure that is to be painted. The choker 84 is secured about a structurally sound and generally centrally located anchor 80, including a man hole combing, for example. The block 88 and leash 86 are connected between the choker and the tie pad 26 at the first end 22 of the truck 10. A lift cable 92 extends from the work basket 14 and is connected with the second end 24 of the truck 10, as will be understood by one having ordinary skill in the art. The truck is positioned adjacent an edge or slope knuckle 90 with the wheels generally parallel with a tangent to an outer arc of the tank 82 (FIGS. 1 and 3). So positioned, the first end 22 of the beam 20 extends back toward the anchor 80, while the second end 24 extends outward beyond a cylindrical side of the tank 82. Users may then winch the work platform 14 up to an upper most position and manipulate the control 72 to relocate the truck and the work platform rotationally about the tank.

In a first alternative embodiment, a second, non-powered truck 100 may be coupled by a tow line 102 with the first truck 10. Now, an extra large work platform by be suspended under both the trucks 10 and 100. When rotational relocation is desired, the platform 114 is lifted to its highest or upper most position and the truck 10 is driven by manipulation of controller 72 to pull the second truck 100.

It will be understood by one having ordinary skill in the art and by those who practice the invention, that various modifications and improvements may be made without departing from the spirit of the disclosed concept. Various relational terms, including left, right, front, back, top, and bottom, for example, are used in the detailed description of the invention and in the claims only to convey relative positioning of various elements of the claimed invention. The scope of protection afforded is to be determined by the claims and by the breadth of interpretation allowed by law.

I claim:

1. A movable scaffold or painting or otherwise servicing elevated sides of a cylindrical tank comprising:

a wheeled truck adapted to be positioned on a top of a tank adjacent a cylindrical peripheral edge, the truck being supported by at least one wheel that is positioned for rotation about a substantially radial axis on the top of the tank;

a powered truck drive mounted in the truck for driving the truck in a direction perpendicular to the wheel axis;

a radial tether having an outer end attached to the truck and having an inner end adapted to be attached to a center portion of the top of the tank by attachment means that permit rotation of the tether about a vertical axis of the tank, the tether constraining the truck to circular movement around the outer peripheral edge of the top of the tank;

a platform suspended from the truck so as to be positioned adjacent a side of the tank when the truck is positioned adjacent an outer peripheral edge of the top of the tank, the platform being constructed to support a paint applicator for surface preparation or application of paint to the tank sides, the platform being connected to the truck by a vertically adjustable hoist that permits the platform to be raised or lowered; and a control mechanism for selectively actuating the powered truck drive to cause circular movement of the truck around the periphery of the tank.

2. The movable scaffold according to claim 1 wherein the control mechanism for driving the truck in a circular path is a remote control mechanism positioned for access from the platform at least when the platform is raised.

3. The movable scaffold according to claim 2 wherein the remote control mechanism is operable only when the platform is in an elevated position such that pendulum movement of the platform is minimized.

4. The movable scaffold according to claim 1 wherein the truck includes at least two wheels.

5. The movable scaffold according to claim 4 wherein the wheels are spaced apart in a longitudinal direction and the platform is supported from a position between the wheels.

6. The movable scaffold according to the claim 5 wherein the scaffold includes two longitudinally spaced trucks, each truck supporting an end of an elongated platform, the truck drive being mounted in at least one of the trucks.

7. The movable scaffold according to claim 1 wherein the truck includes an elongated radial beam positioned in a radial direction, the beam having an inner end that is attached to the tether and an outer end attached to a vertical support cable that supports the platform, the at least one wheel being positioned sufficiently below the beam to movably support the beam above a surface of the tank for movement in a direction perpendicular to the radial direction.

8. The movable scaffold according to claim 7 wherein the truck includes at least two wheels spaced apart in a longitudinal direction and supported at spaced positions on a support beam that is mounted to the radial beam in a position perpendicular thereto.

9. The movable scaffold according to claim 1 wherein the truck drive comprises an electrically operated motor mounted in the truck and drivingly connected to a wheel.

10. The movable scaffold according to claim 1 wherein the attachment means for attaching the inner end of the tether to the tank includes a choker in the form of an enlarged loop that loosely encircles a man hole opening in the center of the top of the tank, the choker extending through a block on the inner end of the tether, such that the block rolls along the choker as the truck follows a circular path around the tank.

11. A method of accessing the sides of an elevated cylindrical tank comprising:

positioning a wheeled truck at an upper peripheral edge of the tank, with one or more truck wheels being mounted for rotation about substantially radial axles;

attaching the truck to the tank by a tether that constrains movement of the truck to a circular path around the periphery of the tank;

suspending a raisable platform from the truck for movement along outer sides of the tank;

providing a powered truck drive for the truck for driving the truck around the periphery of the tank;

providing a lifting mechanism for raising and lowering the platform; and providing a control mechanism for selectively actuating the truck drive to cause circular movement of the truck around the periphery of the tank, and providing a control mechanism for operating the lifting mechanism to raise and lower the platform, such that the platform can be raised and lowered and moved around the circumference of the tank to paint or otherwise service the sides of the tank.

* * * * *